US009402493B2

(12) United States Patent
McAmis

(10) Patent No.: US 9,402,493 B2
(45) Date of Patent: Aug. 2, 2016

(54) HEAVY DUTY RETRACTABLE MOUNTED MULTI-PURPOSE DRYING STATION

(71) Applicant: Timothy J. McAmis, Hawk Point, MO (US)

(72) Inventor: Timothy J. McAmis, Hawk Point, MO (US)

( * ) Notice: Subject to any disclaimer, the term of this patent is extended or adjusted under 35 U.S.C. 154(b) by 0 days.

(21) Appl. No.: 14/573,794

(22) Filed: Dec. 17, 2014

(65) Prior Publication Data

US 2016/0178280 A1 Jun. 23, 2016

(51) Int. Cl.

| | |
|---|---|
| ***A47G 25/06*** | (2006.01) |
| ***A47G 25/74*** | (2006.01) |
| ***A47B 61/02*** | (2006.01) |
| ***D06F 57/12*** | (2006.01) |

(52) U.S. Cl.

CPC ..... *A47G 25/0685* (2013.01); *A47B 61/02* (2013.01); *A47G 25/0664* (2013.01); *A47G 25/746* (2013.01); *D06F 57/12* (2013.01)

(58) Field of Classification Search

CPC ..... A47G 25/0685; A47G 25/746; A47G 25/0664; A47G 25/0657; A47G 25/743; A47K 10/04; A47K 10/10; A47F 7/24; A47F 5/08; A47F 5/0006; D06F 57/12; D06F 53/04; A47B 61/02; A47B 96/061; A47B 57/485; A47B 57/54; A47B 57/56; A47B 96/06

USPC ..... 211/88.04, 99, 204, 100, 104, 87.01, 211/96, 113, 116, 85.3, 16, 117, 89.01, 193, 211/97, 101, 105.1, 118, 48; 248/292.14, 248/291.1

See application file for complete search history.

(56) References Cited

U.S. PATENT DOCUMENTS

| | | | | | |
|---|---|---|---|---|---|
| 826,430 | A * | 7/1906 | Johnson | A47F 5/0846 | 211/16 |
| 977,921 | A * | 12/1910 | Zizinia | A47G 25/0685 | 211/99 |
| 1,675,718 | A * | 7/1928 | Lynch | D06F 93/00 | 248/291.1 |
| 1,695,429 | A * | 12/1928 | Kartzmark | A47K 10/04 | 211/110 |
| 1,713,704 | A * | 5/1929 | Lobel | A47F 5/0884 | 211/119 |
| 1,892,687 | A * | 1/1933 | Teufel | A47G 25/0685 | 16/350 |
| 2,070,174 | A * | 2/1937 | Pace | A47G 25/746 | 211/99 |
| 2,099,495 | A * | 11/1937 | Mirel | A47G 25/746 | 211/97 |
| 2,147,172 | A * | 2/1939 | Poole | D06F 57/12 | 211/99 |

(Continued)

*Primary Examiner* — Joshua Rodden
*Assistant Examiner* — Hiwot Tefera
(74) *Attorney, Agent, or Firm* — Fulwider Patton LLP

(57) ABSTRACT

A multi-purpose retractable drying station comprises a mounting bracket and an elongate main support beam extending from the mounting bracket, the elongate main support beam having a mounting pin that projects through the mounting bracket, the position of the mounting pin in said slots determining a position of the elongate main support beam. The station also comprises a plurality of transverse rods, parallel and spaced apart along the elongate main support beam and mounted thereto, and each transverse rod including a bar serving as a rack for drying articles thereon, the elongate main support beam retracting from a deployed horizontal position to a stowed vertical position.

5 Claims, 5 Drawing Sheets

(56) References Cited

U.S. PATENT DOCUMENTS 2,217,795 A * 10/1940 Dawson ..... A47B 61/02 211/100
2,529,403 A * 11/1950 Mack, Sr. ..... A47G 25/746 211/100
2,562,093 A * 7/1951 Heisler ..... A47G 25/746 211/101
2,615,579 A * 10/1952 Sampson ..... A47G 25/746 211/100
2,632,571 A * 3/1953 Kendis ..... A47G 25/746 211/100
2,666,530 A * 1/1954 Beren ..... A47G 25/746 211/104
3,133,643 A * 5/1964 Lester ..... A47G 25/746 211/116
3,797,790 A * 3/1974 Iseki ..... A47K 10/04 211/107
4,005,842 A * 2/1977 Lane ..... A47F 5/0876 248/200
4,039,064 A * 8/1977 Kirby ..... B23Q 3/10 193/42
4,186,951 A * 2/1980 Stephenson ..... D04G 5/00 289/16.5
4,611,721 A * 9/1986 Heckaman ..... A47G 25/746 211/100
D301,524 S * 6/1989 Trafford ..... D6/324
5,615,783 A * 4/1997 Warnken ..... B68C 1/002 211/104

* cited by examiner

HEAVY DUTY RETRACTABLE MOUNTED MULTI-PURPOSE DRYING STATION

BACKGROUND

In certain areas where water sports are enjoyed, such as swimming, boating, diving, water skiing, and the like, it is common to see various items drying nearby. In particular, towels, wetsuits, bathing suits, and other various items need to be laid out in a place where they can air out and dry, preferably away from areas of foot traffic. However, to lay towels, wet suits, and other various items out to dry, a large area is needed that can be better used for other purposes. Also, without a designated area for such purposes, towels and bathing suits tend to be set on anything nearby that will support them, leading to a cluttered area that can sometimes pose a safety concern if the wet clothing items are placed on objects that have electrical components.

In locations where there are supports, like docks, boat houses, patios, pool decks, cabanas, etc., it would be convenient to have a way to hang various items for drying in a way that allows the system to be stored out of the way when not in use. Such a system would require sufficient strength to support wet clothing such as towels, wet suits, and bathing suits, and be adjustable in both the position and the capacity for storage.

The present invention is directed to such a system.

SUMMARY OF THE INVENTION

The present invention is directed to a retractable multi-purpose drying station that can mount to a vertical post. The station includes a mounting bracket that clamps onto a vertical post, allowing a main support beam to cantilever from a substantially vertical, stowed position to a deployed, horizontal position. The main support beam carries a plurality of towel racks, each rack having a transverse rod passing through or engagement with the main support beam, each transverse rod carrying a bar that can be used to hang a towel thereon. It is to be understood that while the description will focus on a towel drying system, the invention is no so limited and can be used to dry various items such as bathing suits, wet suits, life vests, etc. The mounting bracket releasably clamps onto a square or rectangular post, and slots in the bracket guide a pin connecting the bracket to the main support beam, the slots arranged to permit retraction of the main support beam from the horizontal to the vertical direction. In a first preferred embodiment, the main support beam has a square profile, although other profiles may be used. Further, in one embodiment, the bar is substantially parallel to the transverse rod, with a curved end or ends that form the junction with the transverse rod. In one embodiment, six racks are supported on the system, although more or less racks can be utilized depending upon the application and the available space.

These features, and additional aspects of the present invention, will best be understood when considered in view of the included drawings and the description of the invention below.

DETAILED DESCRIPTION OF THE PREFERRED EMBODIMENTS

The present invention is directed to a multi-purpose drying station that can be used near pools, lakes, oceans, and other bodies of water where people enjoy water sports. The station is designed to be retractable and mount on an existing post or support structure using a unique mounting bracket. The station allows a multitude of wet or damp items to dry simultaneously and, when finished, the station retracts into a stowed position out of the way of pedestrian traffic, the view of the body of water, etc.

Figure 1:
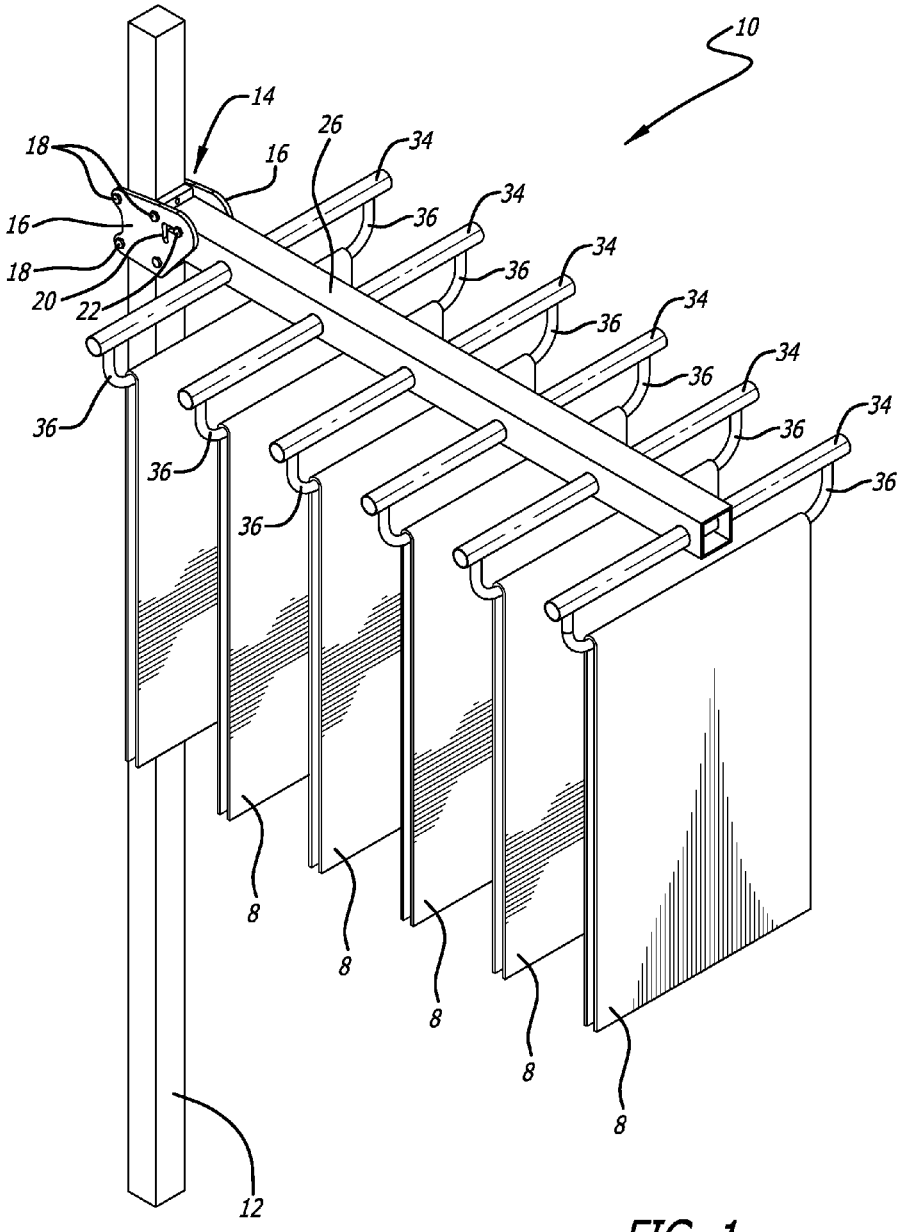
FIG. 1 is an elevated, perspective view of a first preferred embodiment of the present invention.

FIG. 1 illustrates a station 10 used for drying towels 8, although it is to be understood that the station can also be used to hang a wide variety of items, including safety vests, wet suits, bathing suits, floor mats, and virtually any other item that requires air drying. The station 10 is designed to mount quickly and efficiently to an ordinary square or rectangular post 12, such as those typically found near docks, boat houses, beaches, backyard decks, and so on. It should be noted that the station 10 can mount to a wide variety of posts 12, as explained in more detail below, thus providing versatility to the station when compared with alternative solutions.

The station 10 includes a mounting bracket 14 that secures the station 10 to the post 12. The mounting bracket 14 comprises two spaced apart, parallel plates 16 that engage the post 12 from opposite sides. Four or more fasteners 18 pass through associated holes in the parallel plates 16 such that, once tightened, the bracket 14 clamps onto the post 12 in a rigid and reliable manner. The holes may be placed at lugs 32 formed in the plates 16 if stress concentrations dictate the need for additional material around the holes. Multiple sets of holes may be incorporated into the bracket 14 to allow the bracket to fit multiple sized posts. The bracket 14 allows the station 10 to be secured anywhere along the length of the post 12, so that it may be placed at the most convenient height for the particular area and application.

Each plate 16 includes a slot 20, and the plates are arranged so that the respective slots 20 are aligned with respect to the post 12. In a preferred embodiment, the slots 20 are "L"-shaped as shown in FIG. 1, although the slots may have other shapes such as a stepped shape or "T"-shape as called for by the application. The slots 20 act as a guide for a mounting pin 22, which travels in the slots 20 from a first, deployed position to a second, retracted position. A spacer member 24 is preferably located adjacent the post 12 between the two plates 16, stabilizing the mounting bracket 14 while protecting the post 12 from damage by the rotation of the station 10 from the horizontal to the vertical position.

Figure 2:
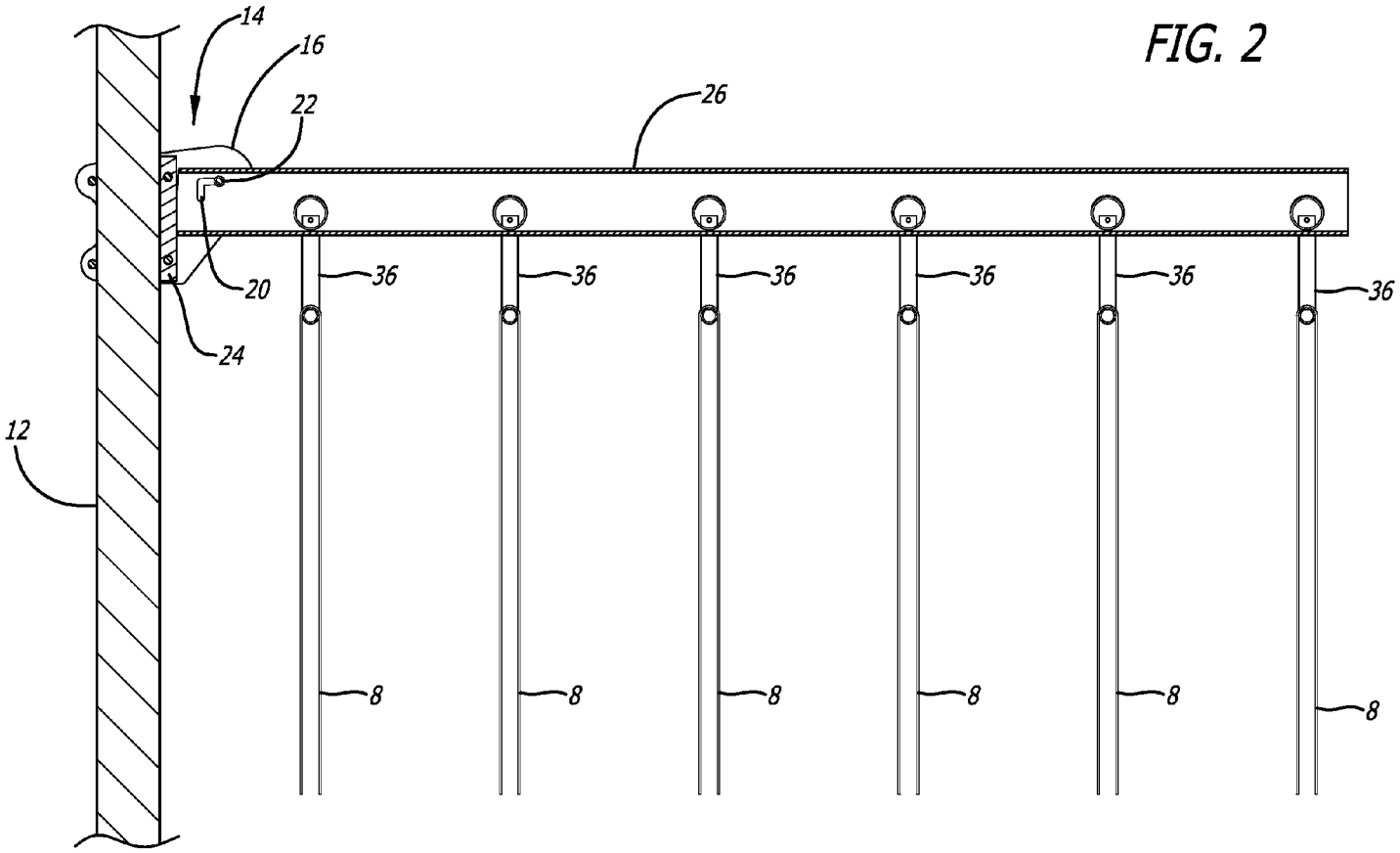
FIG. 2 is a side view, partially cut away, of the embodiment of FIG. 1.
Figure 3:
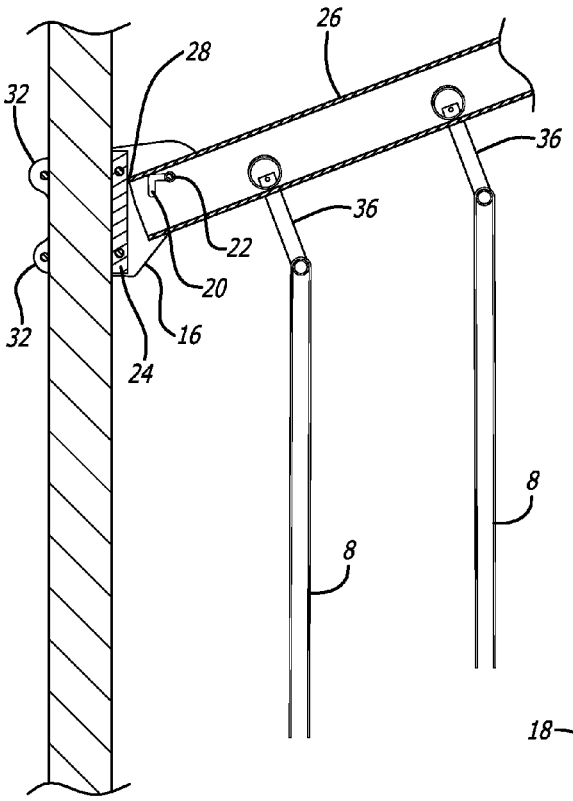
FIG. 3 is an enlarged, side view of a portion of the system of FIG. 1 where the main support beam is partially retracted.
Figure 4:
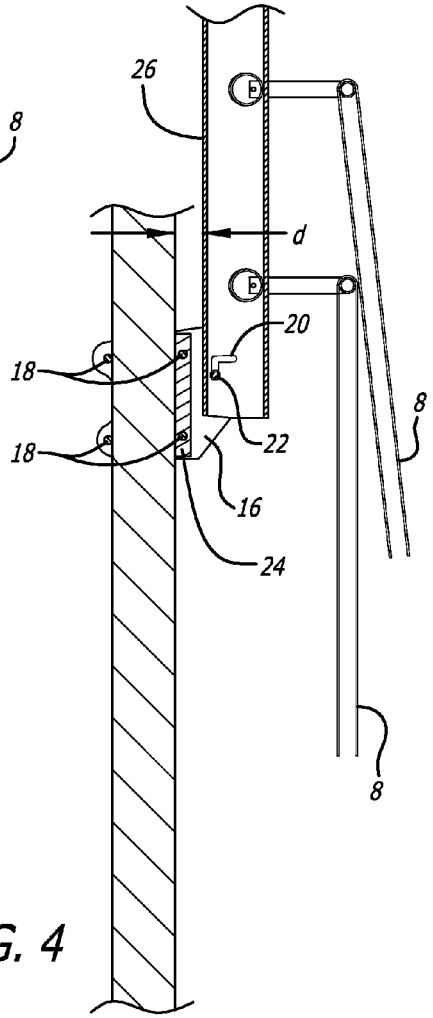
FIG. 4 is an enlarged, side view of a portion of the system of FIG. 1 where the main support beam is fully retracted to a vertical position.
Figure 5:
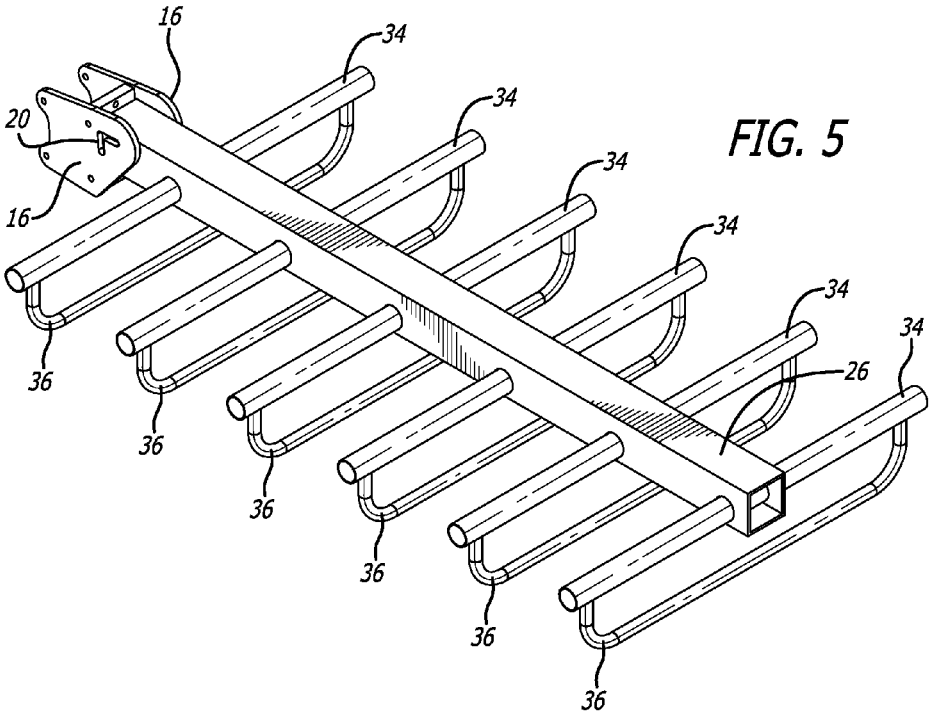
FIG. 5 is an elevated, perspective view of the system without the supporting post.
Figure 6:
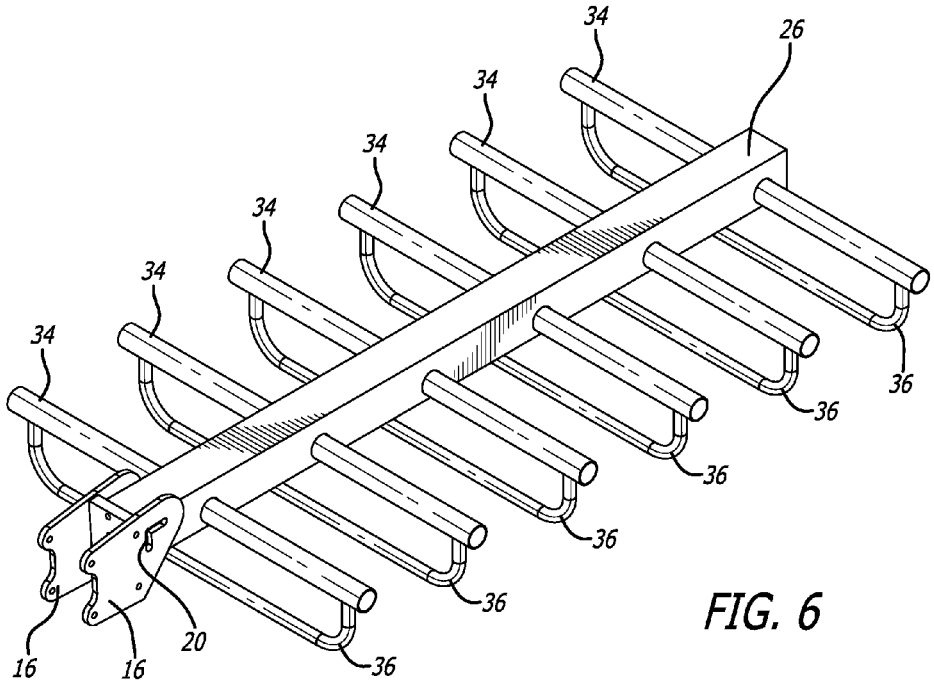
FIG. 6 is another elevated, perspective view of the system without the supporting post.
Figure 7:
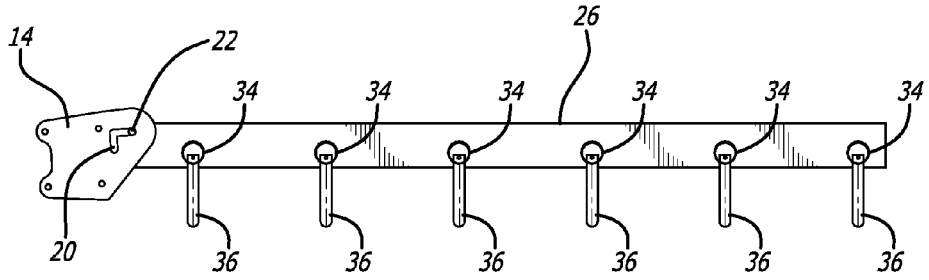
FIG. 7 is a side view of the system of FIG. 1.
Figure 8:
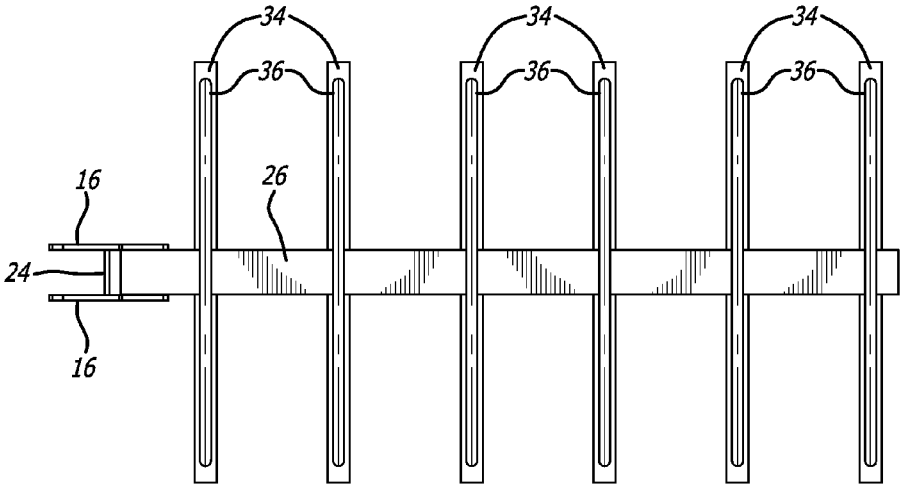
FIG. 8 is a bottom view of the system of FIG. 1.

The mounting bracket 14 cantilevers an elongate, main support beam 26 that pivots in the mounting bracket 14 between a deployed, horizontal position (see FIG. 2) to a retracted, vertical position (see FIG. 4). The elongate support beam is preferably a thin walled, square, hollow aluminum beam that is both strong and lightweight. The elongate main support beam 26 is secured to the mounting bracket 14 via a mounting pin 22 passing through a proximal end of the support beam 26. The mounting pin 22 also passes through the slots 20 on each of the mounting plates 16, and the proximal end of the support beam 26 engages and is flush with the spacer 24 when the support beam 26 is in the deployed, horizontal position as shown in FIG. 2. As the support beam is rotated counterclockwise re the view in FIG. 2 (see FIG. 3), the mounting pin travels through the slots 20 as the corner 28 of the support beam travels down the spacer 24. Once the support beam 26 is vertical, the mounting pin 22 is settled in the lowermost portion of the slot 20, preventing the support beam 26 from inadvertently falling or becoming dislodged from its retracted position (see FIG. 4). The final position of the support beam is spaced a distance "d" from the post 12 to prevent interference between the support beam 26 and spacer 24 during rotation of the support beam.

Spaced along the length of the support beam 26 is a series of parallel, spaced apart transverse rods 34 that are preferably fixed with respect to the main support beam 26. The transverse rods 34, which may by cylindrical, may pass through holes in the support beam, or be welded or otherwise mounted to the support beam along a lower surface. Mounted to at least one end, and preferably both ends of the transverse rod is a towel bar 36 that extends perpendicularly from the transverse rod to a generally horizontal orientation. Whether the main support beam is in the vertical or horizontal position, the towel bars 36 remain in a horizontal orientation. The towel bars 36 are sturdy enough to hang wet clothing, wet towels, life jackets, etc., without bowing or bending. In a preferred embodiment, the towel rods and the transverse rods are also made of aluminum.

The foregoing descriptions and characterizations of the present invention are intended to be illustrative, and not limiting. Various modifications and alternations would be readily apparent to one of ordinary skill in the art, and the present invention is intended to incorporate all such modifications and alterations. Accordingly, the invention should not be limited by any figure or description of the foregoing examples, but rather the scope of the invention is construed based on the claims below, using their ordinary and customary meanings.

I claim:

1. A multi-purpose retractable drying station, comprising:

a mounting bracket having first and second opposed parallel plates each plate having first and second fastener holes vertically aligned at a proximal end and third and fourth fastener holes vertically aligned and horizontally spaced from the first and second fastener holes, each plate further comprising an "L" shaped slot having a horizontal component and a vertical component, the "L" shaped slot horizontally spaced from the third and fourth fastener holes, and a spacer plate having a width W connecting the first and second opposed parallel plates at the third and fourth fastener holes in an "H" profile;

an elongate main support beam extending from the mounting bracket at the spacer plate, the elongate main support beam having a first and second parallel faces that are spaced apart by the width W of the spacer plate and said first and second parallel faces partially disposed between the first and second parallel plates, a mounting pin projecting from each parallel face through a corresponding "L" shaped slot on the parallel plate adjacent the face, the mounting pin in the horizontal component of the "L" shaped slot corresponding to a horizontal position of the elongate main support beam and the mounting pin in the vertical component of the "L" shaped slot corresponding to a vertical position of the elongate main support beam, the elongate main support beam pivoting between the vertical position and the horizontal position depending upon the position of the mounting pin;

a plurality of transverse rods, parallel and spaced apart along the elongate main support beam, each transverse rod passing through a first aperture on the first parallel face and a second aperture on the second parallel face, each transverse rod connected to a bar spaced from and below the elongate main support beam when the elongate main support beam is in the horizontal position; and first and second fasteners passing through the first and second fastener holes for clamping the first and second parallel plates to a vertical post between the spacer plate and the first and second fasteners.

2. The multi-purpose retractable drying station of claim 1, wherein the transverse rods are cylindrical.

3. The multi-purpose retractable drying station of claim 1, wherein the elongate main support beam and the plurality of transverse rods being formed of aluminum.

4. The multi-purpose retractable drying station of claim 1, wherein the mounting bracket is adjustable to various sized posts.

5. The multi-purpose retractable drying station of claim 1, wherein the elongate main support beam is connected to the mounting bracket solely by the mounting pin.

* * * * *